United States Patent [19]

Czarn et al.

[11] Patent Number: 5,015,808

[45] Date of Patent: May 14, 1991

[54] NORMALLY OPEN PRESSURE SWITCH

[75] Inventors: David A. Czarn, Cumberland, R.I.; Aziz Rahman; Alan M. Sadler, both of Attleboro, Mass.; Gary A. Baker, Scituate, R.I.

[73] Assignee: Texas Instruments Incorporated, Dallas, Tex.

[21] Appl. No.: 454,880

[22] Filed: Dec. 22, 1989

[51] Int. Cl.[5] ..... H01H 35/40

[52] U.S. Cl. ..... 200/83 P; 200/83 B; 200/83 Y; 200/302.1

[58] Field of Search ..... 200/83 P, 83 R, 83 B, 200/83 Y

[56] References Cited

U.S. PATENT DOCUMENTS

| | | | |
|---|---|---|---|
| 4,758,695 | 7/1988 | Sanford et al. | 200/83 P |
| 4,853,503 | 8/1989 | Sanford | 200/83 P |
| 4,861,953 | 8/1989 | Sanford | 200/83 P |

*Primary Examiner*—Robert S. Macon

*Attorney, Agent, or Firm*—John A. Haug; James P. McAndrews; Melvin Sharp

[57] ABSTRACT

A normally open pressure responsive switch having upper and lower housings with a snap acting member and an electrically conductive member sandwiched therebetween. The housings each include a body with a hollow center portion and the lower housing has a contact in the center portion extending externally of the member. The snap acting member is in constant engagement with the sandwiched conductive member and normally out of engagement with the contact. When pressure is applied which is sufficient to cause the snap acting member to snap connection is made with the electrically conductive member in the lower assembly. An elastomeric sealing member is mounted in the upper housing and has a neck portion received in the hollow center portion, an integrally attached flange biased against the electrically conductive member and lower housing and an integrally attached lobe extending above the upper housing to seal off the hollow center portion when the switch is mounted at a switch receiving seat.

7 Claims, 3 Drawing Sheets

NORMALLY OPEN PRESSURE SWITCH

BACKGROUND OF THE INVENTION

1. Field of the Invention

This invention relates to a pressure switch and, more specifically, to a pressure responsive switch for mounting on a printed wiring board or an insert molded lead frame assembly which is capable of operating in the normally open condition.

2. Brief Description of the Prior Art

It is relatively standard in the automotive art to control various functions by means of microprocessor based control units to obtain performance improvements.

One such application has included the operation of the transmission system by integrating engine and transmission control. Such operation requires that the transmission control be compatible with the engine control module (ECM) and be electronically accessible with inputs and outputs. One such prior art approach has utilized solenoid valves to effect gear shifting using pressure switches in the solenoid valve assembly as a way to confirm that solenoid valve actuation and deactuation has occurred responsive to pressure change in the hydraulic fluid. This pressure change is sensed using conventional snap acting pressure responsive switches which close or open electrical circuits on the occurrence of selected pressure levels. A problem with switches of this type is that the snap acting switches have a lower life expectancy than is desired.

In U.S. Pat. No. 4,758,695, there is disclosed an attempt to minimize this problem wherein a control system is provided where a metallic diaphragm is used having significantly improved longevity. Such diaphragms are formed with a central dished portion having a pressure deflection relationship such that the diaphragm is relatively stiff, having a positive coefficient of pressure with increasing deflection up to and above a relatively narrow range of set points or calibrated pressures. Within the range of set points the effective spring rate of the diaphragm is relatively supple with only a small increase in pressure resulting in relatively larger travel of the center of the diaphragm. The diaphragms are also characterized in having significantly less hysteresis than conventional snap acting discs to minimize the build up of stresses in the diaphragm since these stresses serve to limit the longevity of the diaphragm. Among the embodiments disclosed are switches in which the diaphragms are formed with an annular flat berm portion which is received on an electrical contact member with an o-ring disposed on top of the berm and biased thereagainst to form a fluid pressure seal by a tubular sleeve which communicates with an hydraulic fluid pressure source. Another embodiment provides a sleeve formed in two segments with the o-ring sandwiched therebetween so that the sleeve itself engages the berm portion.

An electrical contact rivet is placed beneath the central dished portion and connected to a suitable electrical connector. While the berm provides a convenient way to mount and seal the diaphragm, the integral interconnection between the flat berm portion and the central dished portion results in limiting the life of the diaphragm. In other embodiments, the entire diaphragm is dished and maintained on the electrical contact member by means of a thin flexible membrane which also provides a seal for the switch. However, the use of a membrane to retain the diaphragms in their respective seats limits the positioning of the stationary center contact to the low pressure side of the diaphragm (to close a circuit upon pressure increase). That is, the membrane would preclude the use of a fixed contact on the high pressure side of this diaphragm (to open a circuit upon selected pressure increase).

A further improvement in the prior art is set forth in U.S. Pat. No. 4,861,953, by forming the entire surface of the diaphragm into a dished configuration with the center of the diaphragm having a pressure versus deflection relationship such that for increasing pressure from 0 psig up to and beyond a plateau having a range of deflections between d1 and d2, the diaphragm has a relatively stiff effective spring rate with the center deflecting between d1 and d2 at essentially the same pressure level, the diaphragm also having a relatively narrow differential between the pressure at which the center of the diaphragm deflects between d1 and d2 on increasing pressure and the pressure at which it deflects between d2 and d1 on decreasing pressure.

In application Ser. No. 07/286,726, filed Dec. 20, 1988, switches are described comprising, in one embodiment, upper and lower housings with a snap acting member and an electrically conductive member sandwiched between the upper and lower housings. The upper housing includes an electrically insulating body with a hollow center portion which is molded around an electrically conductive member having a contact portion in the hollow center portion, the conductor extending externally of the insulating body. The snap acting member is in constant contact with the sandwiched electrically conductive member and normally in engagement with the contact of the upper housing. When a pressure is applied which is sufficient to cause the snap acting member to snap into its second stable state, the engagement thereof with the contact in the upper housing is broken and engagement is made with the contact in the lower housing.

The switch can be provided as normally closed by removing the portion of the conductor on the lower housing which extends externally of said member. The switch can be provided as normally open by removing the portion of the conductor on the upper housing which extends externally of said member.

The hollow center portion of the upper housing is adapted to be placed in communication with a fluid pressure source with a compressible o-ring mounted in a groove provided in the top surface of the housing member to provide a suitable seal preventing leakage and contamination problems. However, in assembling switches of this type problems have occurred with o-rings becoming dislodged so that in some instances they are askew or even missing thereby causing leakage problems and requiring extra inspection and handling. These o-rings are very small making handling difficult. Adhesive has been used on the o-rings in an attempt to obviate this problem but the use of adhesive is not a completely satisfactory solution for several reasons. Using adhesive adds another process step in assembling the switch as well as increasing the material cost of the device and the possibility of adhering the o-rings in askewed orientation within the seating groove is more significant than desirable but more importantly the adhesive can become a source of contamination in the hydraulic system and cause problems with the control valves in the system.

It is therefore an object of the present invention to provide a pressure responsive switch particularly useful in applications involving engine control modules (ECM) or the like which have improved sealing means to avoid leakage and contamination problems associated with the use of such switches.

SUMMARY OF THE INVENTION

Briefly, in accordance with the invention, there is provided upper and lower body housings with a snap acting member and an electrically conductive member sandwiched between the upper and lower housings. The housings each have a hollow central region with a first electrically conductive member having a contact portion extending into the hollow region of the lower housing, the conductive member extending externally of the lower housing, and a second electrically conductive member received between the upper and lower body housings. The second conductive member has an aperture extending therethrough aligned with the hollow region and mounts a pressure responsive snap acting member over the aperture and is adapted to move into and out of engagement with the contact portion of the first conductive member. The second conductive member also extends externally of the body housings. A flexible sealing member having a neck portion with an outwardly extending lobe portion connected thereto through an integral web and an outwardly extending flange connected to the neck portion adapted to cooperate with a wall portion of the upper body housing. A lower surface of the wall is received on the flange of the sealing member biasing the flange against the second electrically conductive member through a gasket while an upper surface of the wall forms a reaction surface for the lobe portion. The lobe portion extends above the upper body housing so that when the switch is mounted against a switch seat the lobe portion will be biased against the upper wall surface.

DESCRIPTION OF THE PREFERRED EMBODIMENT

Figure 1:
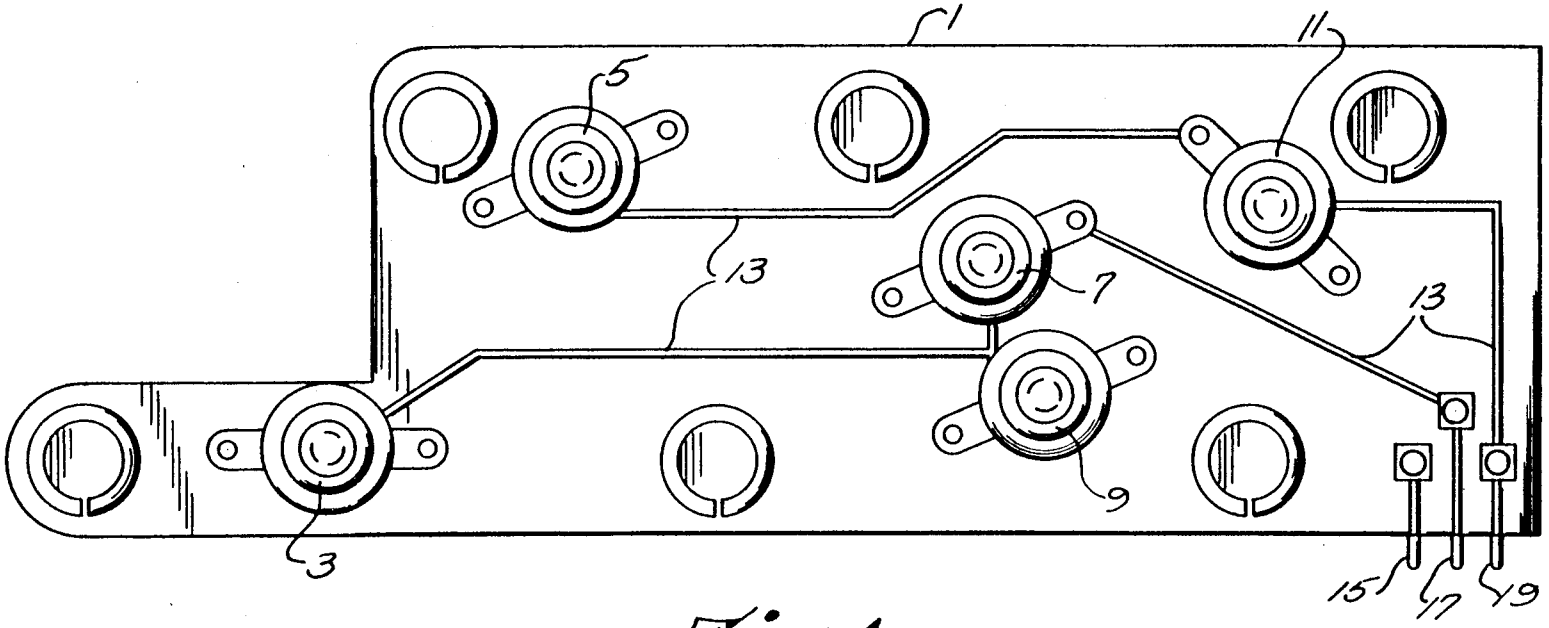
FIG. 1 is a top view of a printed wiring board containing several pressure responsive electrical switches mounted thereon in accordance with the present invention.
Figure 2:
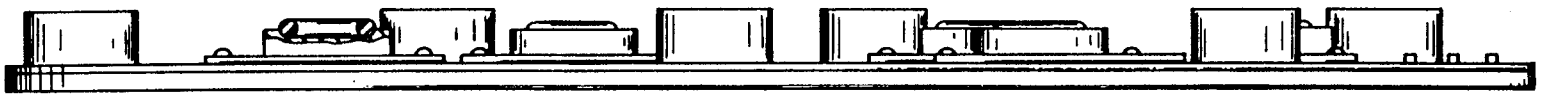
FIG. 2 is a front view of the FIG. 1 board.

Referring first to FIGS. 1 and 2, there is shown a top view of a printed wiring board 1 which is formed of electrically insulating material in a well known manner and has pressure responsive electrical switches mounted thereon. Five such electrical switches 3, 5, 7, 9 and 11 are shown.

The switches are each connected to electrical conductors 13 on the board 1 via pads on the board (not shown) for contacting terminals of the switches (to be discussed hereinbelow), these conductors interconnecting with plural ones of the switches and/or with terminals 15, 17 and 19 at the edge of the board for interface with external devices. The board 1 is secured to a hydraulic manifold, for example, a valve body or other appropriate support (not shown), whereby the upper surface of each of the pressure responsive switches 3 through 11 abuts and is in hermetic sealing relationship with a variable pressure source in the valve body whereby such pressure causes each switch to open in accordance with the degree of pressure then present at each switch as will be explained in greater detail hereinbelow.

Figure 3:
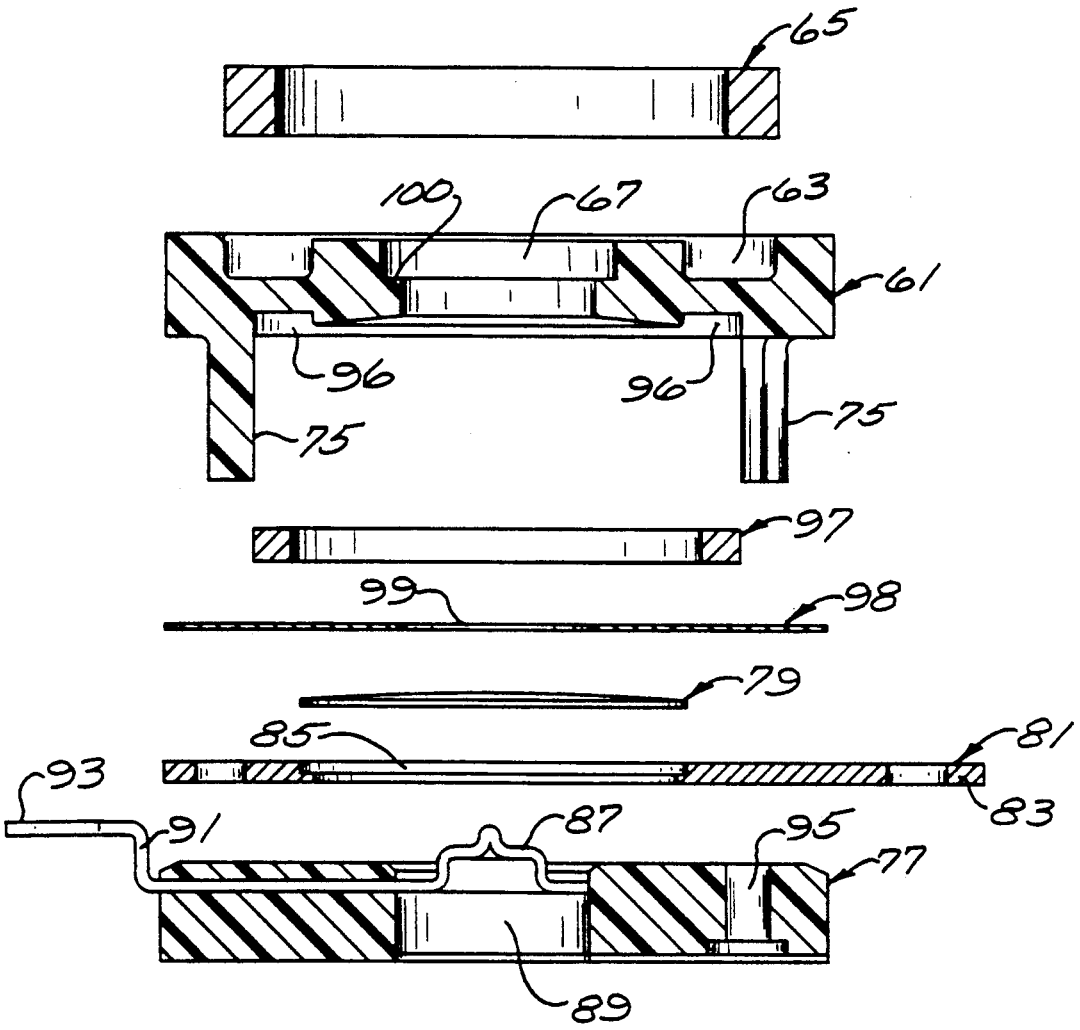
FIG. 3 is an exploded view of a prior art switch.

With reference to FIG. 3, an exploded view of a switch structure which is also described in copending application Ser. No. 07/286,726 referenced above, includes an upper housing 61 having an annular groove 63 for receiving an o-ring or gasket of other geometric shape 65 therein and a hollow center region 67. The housing 61 is formed of electrically non-conductive plastic and includes depending legs 75 for mating with a lower housing 77. An annular internal elastomer gasket 97 is positioned in an annular groove 96 formed in the lower portion of upper housing 61. A Kapton gasket 98 is positioned over the internal gasket 97 with the disc 79 contacting the Kapton gasket. An electrically conductive stainless steel snap acting disc 79 is disposed on a disc seat 81 in the form of an electrically conductive brass member having a terminal wing portion 83 for connection to the board 1, the disc seat also having an apertured center portion 85 for allowing the disc 79 to travel therethrough to contact a contact member 87 when in the snapped position. The lower housing 77 has a hollow center region 89 for receiving the contact 87. The lower housing 77 is formed of electrically non-conductive plastic and includes a brass conductive member 91 molded therein, the conductor having the contact 87 as a portion thereof and a terminal wing portion 93 extending from the contact for connection to the circuit board 1. The lower housing 77 also includes bores 95 for receiving the legs 75 therein whereby the disc 79 and the disc seat can be secured or sandwiched between the upper and lower housings. A filter seat portion 100 is provided in the hollow center region 67 to accommodate, if desired, a filter to prevent large contaminants from reaching the switching area.

Although not disclosed in Ser. No. 07/286,726, in order to ensure that o-ring 65 does not become dislodged a selected amount of adhesive may be used to affix the o-ring to housing 61 in groove 63.

The switch is assembled by stacking the members in the arrangement shown in FIG. 7 and forcing the leg 75 of the upper housing into bores 95 of the lower housing. The circuit path is from the circuit board to the disc seat 81 and then to the disc 79. Upon increase in pressure on the disc 79, the disc will snap to the lower position into engagement with contact member 87, thereby completing the circuit to the wing 93 and then to the lead frame to complete the circuit.

The switch components are held together by three plastic pins or legs 75 which extend from the bottom side of the upper housing 61 into the bores 95 in the lower housing 77. The disc and disc seat are sandwiched between the upper and lower housings 61 and 77. The legs 75 are secured in the apertures by conventional means, such as by heat staking.

During the assembly of the switch, the lower contact 87 is adjusted relative to the location of the disc 79 to assure that the electrical contact is in the proper position relative to the characteristic disc movement. The calibration of each switch assures a change in electrical continuity at a given operating pressure.

Figure 4:
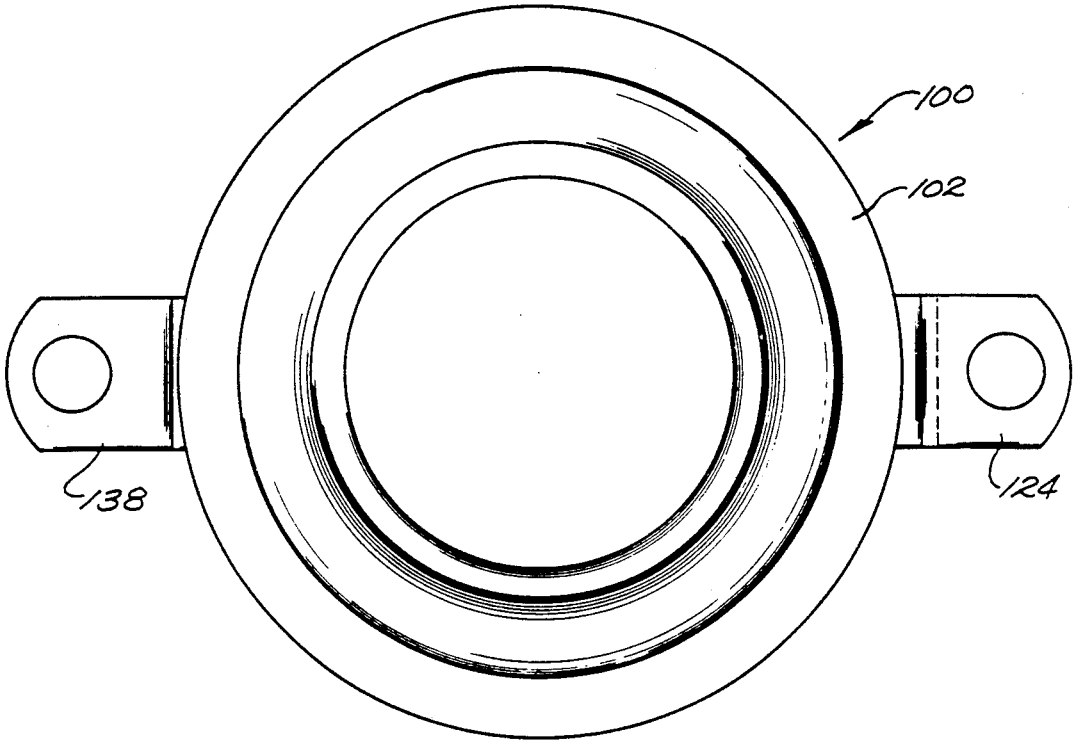
FIG. 4 is a top plan view of a switch made in accordance with the invention.
Figure 5:
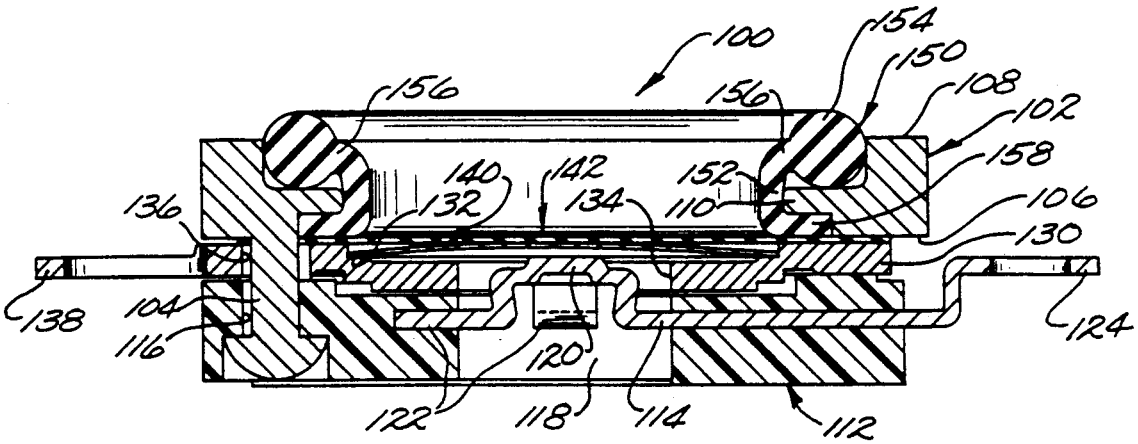
FIG. 5 is a cross sectional view of the FIG. 4 switch.

With reference to FIGS. 4 and 5 a normally open switch 100 made in accordance with the invention is shown comprising an upper housing 102 formed of any suitable material, such as plastic. Upper housing 102 is a generally circular body having a plurality of downwardly depending legs 104 (only one being shown), a bottom surface 106, a top surface 108 and an inwardly extending wall 110 intermediate the top and bottom surfaces. Housing 102 is formed with a central open region 111.

Switch 100 also includes a lower housing 112 formed of suitable electrically insulative material, such as plastic with an electrically conductive member 114 insert molded therein. Housing 112 is formed with bores 116 (only one of which is shown) for reception of legs 104 of upper housing 102 and with a hollow central region 118. Conductive member 114 is formed with an upwardly extending contact portion 120 and support fingers 122 embedded in lower housing 112. Conductive element 114 extends externally of lower housing 112 and has a wing terminal 124 formed at its distal free end.

A second electrically conductive member 130 is received between upper and lower housing members 102, 112 and is formed with a disc seat 132 therein. Second conductive member 130 has a centrally located aperture 134 aligned with and generally the same diameter as the hollow region of lower housing 112, as well as respective apertures 136 (only one being shown) to permit passage therethrough of legs 104. Second conductive member 130 extends externally of housings 102, 112 and has a wing terminal 138 formed at its distal free end.

A stainless steel, pressure responsive snap acting disc 140, with its at rest convex surface facing upwardly as seen in FIG. 5, is received on disc seat 132 and a fluid sealing membrane 142 of Kapton or other suitable material is placed over the disc and beneath lower surface 106 of upper housing 102. The position of contact portion 120 is selected so that it lies essentially on the same plane as the seat 132 of the snap acting member. Fingers 122 are bent appropriately to position the contact portion preferably within 0.001 inch of surface 132.

A generally annular sealing member 150 of suitable elastomeric material has a neck portion 152 received in the central open region 111 of housing 102 to which is connected an outwardly extending lobe portion 154 integrally connected to neck 152 via web 156. An outwardly extending flange 158 also integrally connected to neck 152 is received under the lower surface of wall 110. The unrestrained thickness of flange 158 is somewhat thicker than the height between the lower surface of wall 110 and the lower surface 106 of upper housing 102 so that when housings 102 and 112 are fixed to one another by heat staking the ends of legs 104 or the like, a good compressive seal is formed between flange 158 and gasket 142 with a force being transferred from wall 110 to second conductive member 130 and lower housing 112 through flange 158 and gasket 142.

Lobe 154 extends above top surface 108 of upper housing 102 so that when switch 100 is mounted on a switch seat (not shown) lobe 154 is biased between the top reaction surface of wall 110 and the switch seat to form an effective seal which is not subject to dislodgment. Sealing member 150 thus forms an improved seal without the use of adhesives and along with gasket 142 provide a leak proof switch structure.

Though the invention has been described with respect to a specific preferred embodiment thereof, many variations and modifications will immediately become apparent to those skilled in the art. It it therefore the intention that the appended claims be interpreted as broadly as possible in view of the prior art to include all such variations and modifications.

What is claimed:

1. A pressure responsive switch comprising:

(a) an upper body housing having a first hollow central region, (b) a lower body housing formed of electrically insulative material having a second hollow central region and a first electrically conductive member having a contact portion extending into the second hollow region, the conductive member extending externally of the lower body housing, (c) a second electrically conductive member received between the upper and lower body housings, the second conductive member having an aperture extending therethrough aligned with the hollow region of the lower body housing, the contact portion extending into the aperture, and the second conductive member extending externally of the first and second body housings, an electrically conductive, pressure responsive snap acting member responsive to predetermined pressure thereagainst to switch from an upwardly extending condition to a downwardly extending condition supported on the second electrically conductive member over the aperture, (d) a flexible sealing member having a neck portion, an outwardly extending lobe portion integrally connected to the neck portion, and an outwardly extending flange integrally connected to the neck, the upper body housing having a wall portion with upper and lower surfaces, the lower surface of the wall portion received on the flange of the sealing member biasing the flange against the second conductive member, and the upper surface of the wall portion forming a reaction surface for the lobe portion, the lobe portion extending above the upper body housing whereby mounting of the switch with the lobe portion biased against a switch seat will bias the lobe portion between the upper wall surface and the switch seat.

2. A pressure responsive switch according to claim 1 further including a membrane disposed over the second electrically conductive member and snap acting member and beneath the sealing member flange.

3. A pressure responsive switch comprising an upper body housing having a hollow central region and having a plurality of downwardly depending legs, a lower body housing mounting a first electrically conductive member aligned with the hollow central region, an electrically conductive, pressure responsive, snap acting disc, a second electrically conductive member having a disc receiving seat disposed between the upper and lower body housings electrically separated from the first electrically conductive member, an aperture formed in the second electrically conductive member within the area circumscribed by the disc receiving seat, the disc disposed on the disc seat and being movable into and out of engagement with the first electrically conductive member through the aperture, bores formed through the lower body housing in alignment with the legs of the upper body housing, a sealing member having a neck portion received in the hollow central region of the upper body housing and having an integrally attached, outwardly extending annular flange received under a wall surface of the upper body housing and an integrally attached annular lobe portion extending above the upper body housing, the wall surface being spaced from the lower surface of the upper body housing less than the unrestrained thickness of the sealing flange whereby when the legs are placed in respective bores to fix the housings together a compressive force is applied to the sealing flange.

4. A pressure responsive switch according to claim 3 further including a membrane disposed over the second electrically conductive member and snap acting member and beneath the sealing member flange.

5. A pressure responsive switch comprising an upper body housing having a hollow central region, a lower body housing mounting a first electrically conductive member aligned with the hollow central region, an electrically conductive, pressure responsive, snap acting disc, a second electrically conductive member having a disc receiving seat disposed between the upper and lower body housings electrically separated from the first electrically conductive member, an aperture formed in the second electrically conductive member within the area circumscribed by the disc receiving seat, the disc disposed on the disc seat and being movable into and out of engagement with the first electrically conductive member through the aperture, a sealing member having a neck portion received in the hollow central region of the upper body housing and having an integrally attached, outwardly extending annular flange received under a wall surface of the upper body housing and an integrally attached annular lobe portion, the wall surface being spaced from the lower surface of the upper body housing less than the unrestrained thickness of the sealing flange and means to secure the housings together whereby when the housings are fixed together a compressive force is applied to the sealing flange.

6. A pressure responsive switch according to claim 5 further including a membrane disposed over the second electrically conductive member and snap acting member and beneath the sealing member flange.

7. A pressure responsive switch according to claim 5 in which the lobe portion extends above the upper body housing.

* * * * *